US010526885B2

(12) United States Patent
Fouda et al.

(10) Patent No.: US 10,526,885 B2
(45) Date of Patent: Jan. 7, 2020

(54) REELABLE SENSOR ARRAYS FOR DOWNHOLE DEPLOYMENT

(71) Applicant: Halliburton Energy Services, Inc, Houston, TX (US)

(72) Inventors: Ahmed Fouda, Houston, TX (US); Etienne Samson, Houston, TX (US); Tasneem Mandviwala, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 241 days.

(21) Appl. No.: 15/129,139

(22) PCT Filed: Jan. 8, 2016

(86) PCT No.: PCT/US2016/012587

§ 371 (c)(1),
(2) Date: Sep. 26, 2016

(87) PCT Pub. No.: WO2017/119896

PCT Pub. Date: Jul. 13, 2017

(65) Prior Publication Data

US 2018/0066509 A1 Mar. 8, 2018

(51) Int. Cl.
*E21B 47/01* (2012.01)

(52) U.S. Cl.
CPC ..... *E21B 47/01* (2013.01)

(58) Field of Classification Search
CPC ..... E21B 47/01
USPC ..... 73/152.28
See application file for complete search history.

(56) References Cited

U.S. PATENT DOCUMENTS 6,431,271 B1 * 8/2002 Thomeer ..... E21B 17/206 166/195
6,788,263 B2 9/2004 Clark et al.
2002/0119271 A1 * 8/2002 Quigley ..... B29C 70/086 428/36.9
2004/0206187 A1 * 10/2004 Williams ..... E21B 47/0006 73/766
2007/0289741 A1 * 12/2007 Rambow ..... E21B 47/0006 166/250.01
2010/0078164 A1 4/2010 Bostick, III et al.
2013/0119996 A1 5/2013 Mackay et al.
2014/0191761 A1 * 7/2014 San Martin ..... E21B 47/011 324/339
2014/0222343 A1 * 8/2014 Samson ..... G01V 8/10 702/8
2015/0117810 A1 4/2015 Taverner et al.
(Continued)

FOREIGN PATENT DOCUMENTS

WO WO-2017099807 A1 * 6/2017 ..... G01V 3/18

OTHER PUBLICATIONS

International Search Report and the Written Opinion of the International Search Authority, or the Declaration, dated Sep. 12, 2016, PCT/US2016/012587, 18 pages, ISA/KR.

*Primary Examiner* — Natalie Huls
*Assistant Examiner* — Monica S Young
(74) *Attorney, Agent, or Firm* — Haynes and Boone, LLP

(57) ABSTRACT

Reelable sensors arrays are independently fabricated separate from a downhole tubular. The sensor arrays are then reeled together onto a spool. At the well site, the sensor array is unreeled from the spool and attached to the tubular as it is deployed downhole, resulting in a fast and efficient method of sensor deployment.

22 Claims, 10 Drawing Sheets

(56) References Cited

U.S. PATENT DOCUMENTS

| | | | | |
|---|---|---|---|---|
| 2015/0128705 | A1* | 5/2015 | Daton-Lovett | E21B 47/0001 73/570 |
| 2016/0258271 | A1* | 9/2016 | McCoy | E21B 47/00 |
| 2016/0338274 | A1* | 11/2016 | Messner | A01G 25/16 |
| 2018/0135405 | A1* | 5/2018 | Fouda | E21B 47/0005 |
| 2018/0252100 | A1* | 9/2018 | Ranjan | G01V 3/18 |

* cited by examiner

REELABLE SENSOR ARRAYS FOR DOWNHOLE DEPLOYMENT

PRIORITY

The present application is a U.S. National Stage patent application of International Patent Application No. PCT/US2016/012587, filed on Jan. 8, 2016, the benefit of which is claimed and the disclosure of which is incorporated herein by reference in its entirety.

FIELD OF THE DISCLOSURE

The present disclosure relates generally to downhole sensors and, more specifically, to pre-manufactured sensors adapted to be reeled on a spool.

BACKGROUND

In the oil and gas industry, downhole sensors are deployed to acquire various characteristics of the formation and wellbore environment. In one application, electromagnetic ("EM") sensors (transmitters and receivers) are permanently deployed during completion operations along with the casing. For such applications, hundreds of transmitters and receivers will need to be deployed, which is very time-consuming. Given that the cost associated with a wellbore can rise to $400,000 per day, the deployment of the sensors is also a very expensive proposition.

Conventional methods to deploy sensors are inefficient and very time consuming. In the conventional method, a transmitter deployment requires the assembling of a ferrite collar around a tubular at the well site. Once the ferrite collar is attached, an electrical cable is wrapped around the collar to thereby fabricate the transmitter at the wellsite. Thereafter, the tubular is deployed downhole. Thus, the conventional method of fabricating sensors at the well site is very time consuming.

DESCRIPTION OF ILLUSTRATIVE EMBODIMENTS

Illustrative embodiments and related methods of the present disclosure are described below as they might be employed in a reelable sensor array for downhole applications. In the interest of clarity, not all features of an actual implementation or method are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

As described herein, illustrative systems and methods of the present disclosure are directed to reelable sensors arrays that are independently fabricated separate from a downhole tubular. The sensors are first fabricated and attached to one another using a cable, thereby forming a sensor array. The sensors and cable are then reeled together onto a spool. At the well site, the sensor array is unreeled from the spool and attached to the tubular as it is deployed downhole, thereby removing the need to construct the sensors and make electrical connections at the well site. As a result, a fast and efficient method of sensor deployment is provided.

Figure 1A:
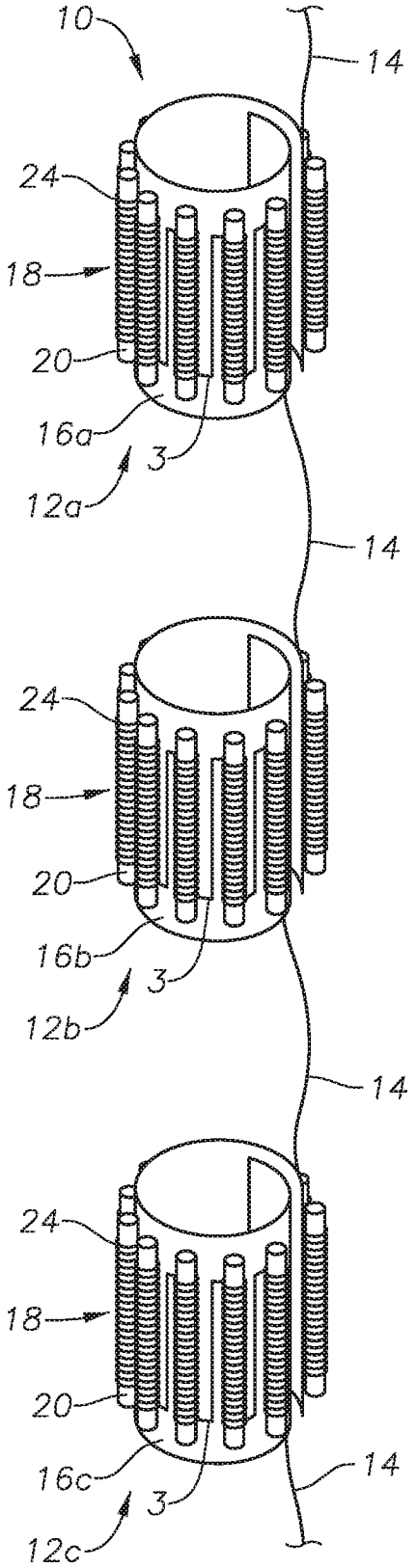
FIG. 1A illustrates a reelable sensor array, according to certain illustrative embodiments of the present disclosure.

FIG. 1A illustrates a reelable sensor array, according to certain illustrative embodiments of the present disclosure. Reelable sensor array 10 includes a plurality of sensor assemblies 12*a*, 12*b* and 12*c*. Although three are shown, sensor array 10 may include more or less sensor assemblies. Sensor assemblies 12*a*-12*c* are communicably coupled to one another via a cable 14 which, in this example, may be a power and/or data communications cable. However, as will be described below, the cable may be a variety of other cables such as fiber optic. Sensor assemblies 12*a*-12*c*, or individual sensors 18, may be utilized as transmitters and/or receivers depending upon their design, as understood by those ordinarily skilled in the art having the benefit of this disclosure. For example, sensors 18 can be used as transmitters when power is provided via cable 14. Alternatively, sensors 18 may act as receivers when connected to pre-amplifiers of optical sensors.

Each sensor assembly 12*a*-12*c* is comprised of a flexible backing 16*a*-16*c*, respectively. Flexible backings 16*a*-*c* are foldable as shown in FIG. 1A. Flexible backings 16*a*-*c* may be made of a variety of foldable materials such as, for example, resins, fiber glass, plastics or other foldable materials suitable for the high temperature downhole environment. Each flexible backing 16*a*-*c* includes a plurality of sensors 18 positioned there-around. In this illustrative embodiment, sensors 18 are comprised of a ferrite core 20 and coils 24; however, other sensor designs (e.g., toroids, galvanic and capacitive electrodes, etc.) may be utilized. In the case of electrodes, the sensors may be wrapped around non-conductive casings/tubulars, such as those made of fiberglass or conductive tubulars coated with non-conductive material such as, for example, resin, polymers or insulating paint. Nevertheless, sensors 18 may be connected to flexible backing 16 in a variety of ways, including, for example, the two ends of the sensor can be clamped to the flexible backing. In certain embodiments, the clamps are made of non-conductive materials so that they may not interfere with the electromagnetic sensors. As shown in FIG. 1A, sensor array 10 is now completely fabricated and ready for use.

Figure 1C:
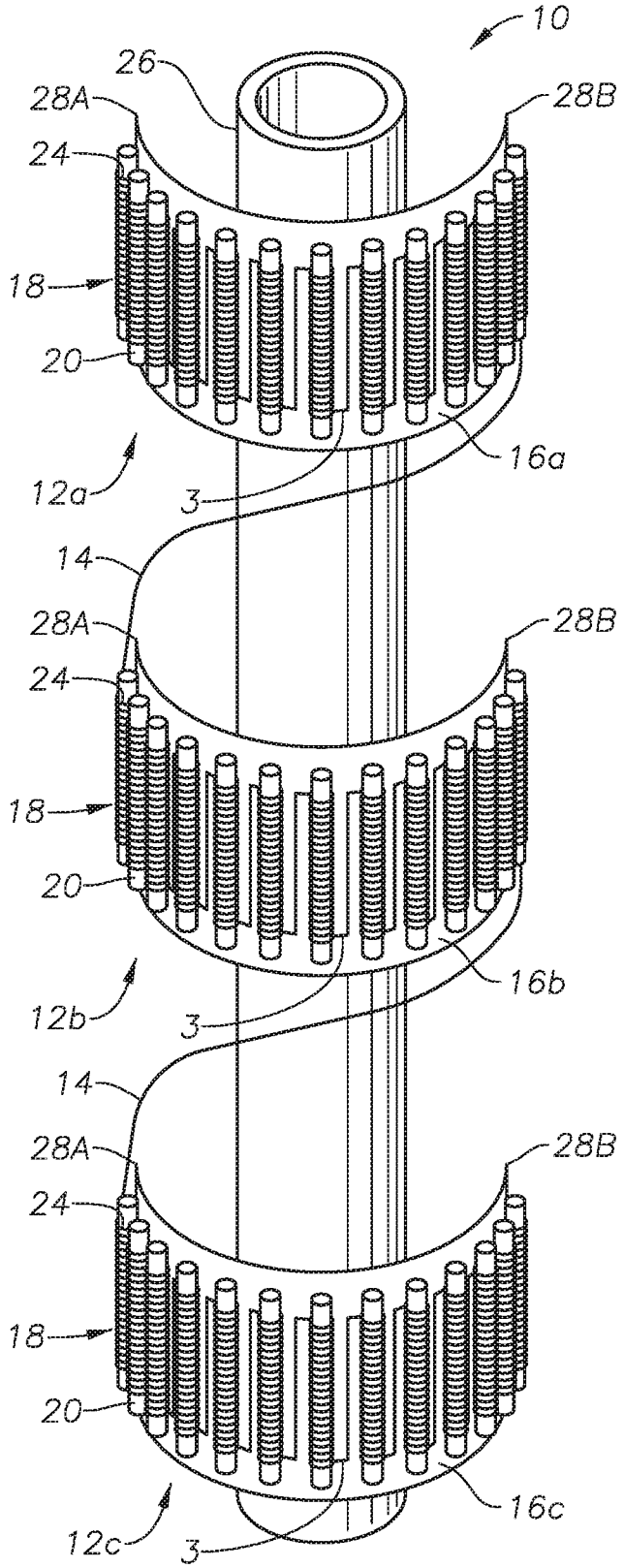
FIG. 1C shows sensor array being attached to a tubular, according to certain illustrative methods of the present disclosure.
Figure 1B:
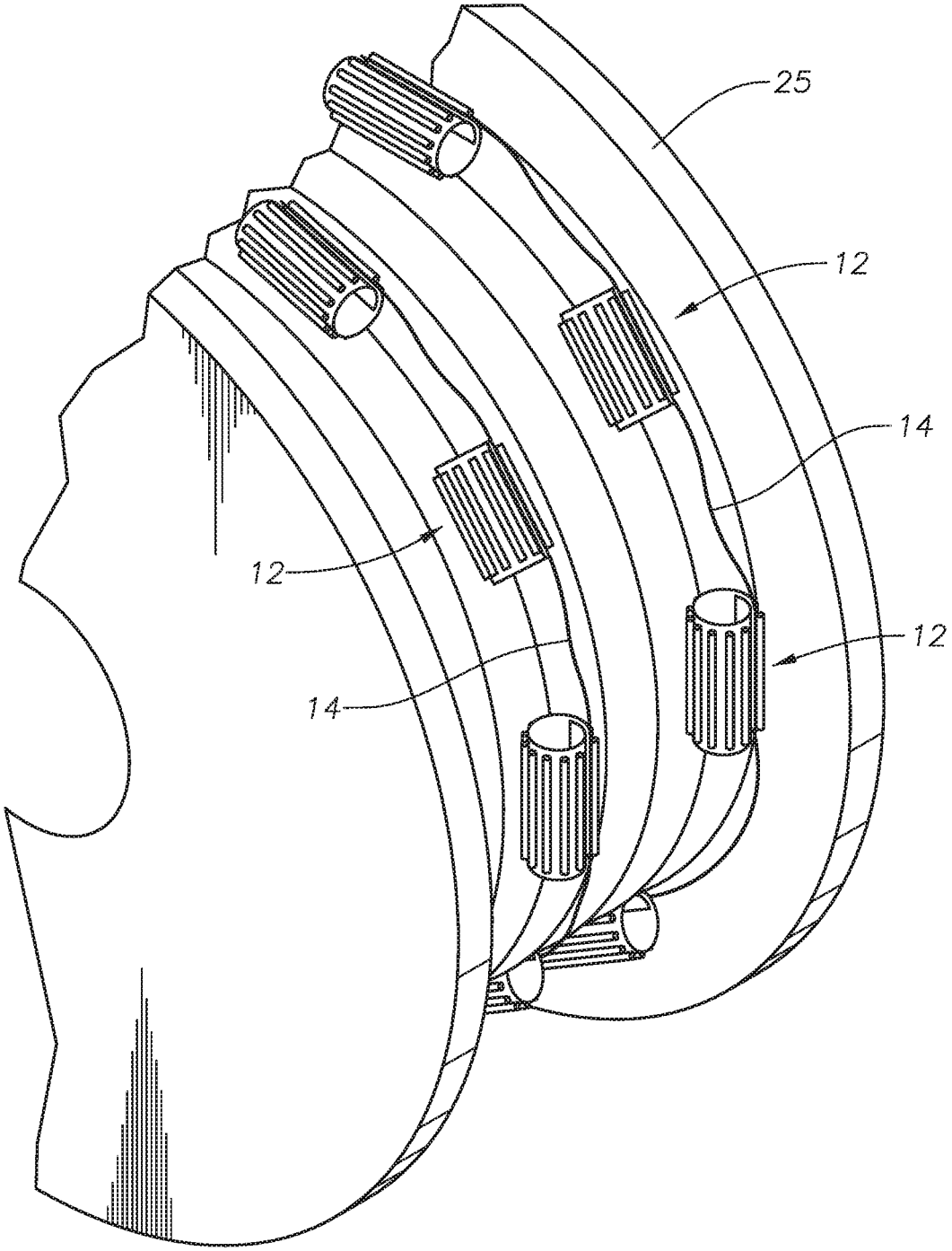
FIG. 1B shows pre-fabricated sensor array reeled onto a spool, according to certain illustrative methods of the present disclosure.

FIG. 1B shows pre-fabricated sensor array 10 reeled onto a spool, according to certain illustrative methods of the present disclosure. After fabrication of sensor array 10, it may be reeled onto a spool 25. In certain embodiments, although not shown, flexible backings 16 may be wrapped around a rigid body before sensor array 10 is reeled onto spool 25. The rigid body may be, for example, tubular in shape, and made of a hard material such as plastic, wood or metal. The rigid body will assist in preventing any damage to sensor assemblies 12 caused by bending of coils 24.

After being reeled onto spool 25, sensor array 10/spool 25 may be transported to a well site. However, in other methods, sensor array 10 may be reeled onto spool 25 at the well site. Nevertheless, once reeled, sensor array 10 is now ready to be attached to a downhole tubular in a quick and efficient manner. FIG. 1C shows sensor array 10 being attached to a tubular, according to certain illustrative methods of the present disclosure. Here, sensor array 10 is being attached to tubular 26 as tubular 26 is deployed downhole.

Figure 1D:
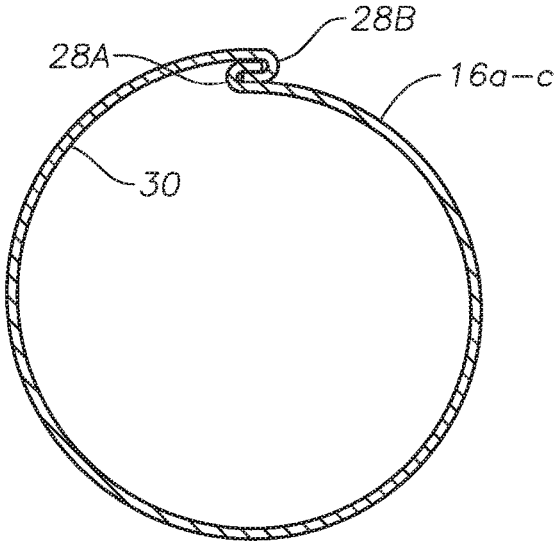
FIG. 1D is a sectional depiction of flexible backing having a connector, according to certain illustrative embodiments of the present disclosure.

In order to attach this illustrative embodiment of sensor array 10, each flexible backing 16*a-c* is wrapped around tubular 26. Flexible backing 16 may be secured to tubular 26 in a variety of ways. FIG. 1D is a sectional depiction of flexible backing having a connector, according to certain illustrative embodiments of the present disclosure. Note that FIG. 1D depicts flexible backing 16 without sensors 18 for clarity and simplification. In this example, as well as with reference to FIG. 1C, flexible backing 16 includes two opposing ends 28A and 28B. In FIG. 1D, ends 28A and 28B are "J" shaped ends that mate with one another to form a connector. During application, flexible backing 16 is wrapped around tubular 26, and ends 28A,B are mated together. Note, however, that a variety of other suitable connectors may be integrated with flexible backing 16.

In certain illustrative embodiments, flexible backing 16 may be made of an elastomeric type material. As in certain other embodiments described herein, the length of flexible backing 16 will be determined based upon the size of tubular 26. Thus, in embodiments using the elastomeric type material, the length of flexible backing 16 may be a little shorter than that required to completely surround tubular 26. When the shorter flexible backing 16 is wrapped around tubular 26, it is stretched and ends 28A,B are connected. After the connection is made, the elastic flexible backing 26 then compresses against tubular 26, thus securing it. Additionally, with reference to FIG. 1D, an adhesive may be applied to the inner diameter 30 of flexible backing 16, thereby further securing it to tubular 26 after it has been wrapped. Although not shown, sensors 18 are positioned on the opposing outer diameter of flexible backing 16. The adhesive may be made of epoxy, for example, or other materials that can withstand the high temperature downhole. In yet other embodiments, after each sensor assembly 12 has been wrapped around tubular 26, a clamp may be positioned around the assemblies and/or cable 14 to secure them to tubular 26. The clamps are preferably made of non-conductive materials so that they may not interfere with the electromagnetic sensors. These and other securement methods may be combined as desired.

Moreover, in certain other illustrative embodiments, flexible backing 16 may include a pocket in which sensors 18 are positioned. Depending upon the sensor design utilized, the pockets may be conductive or non-conductive, and may completely or partially cover sensors 18.

Figure 1F:
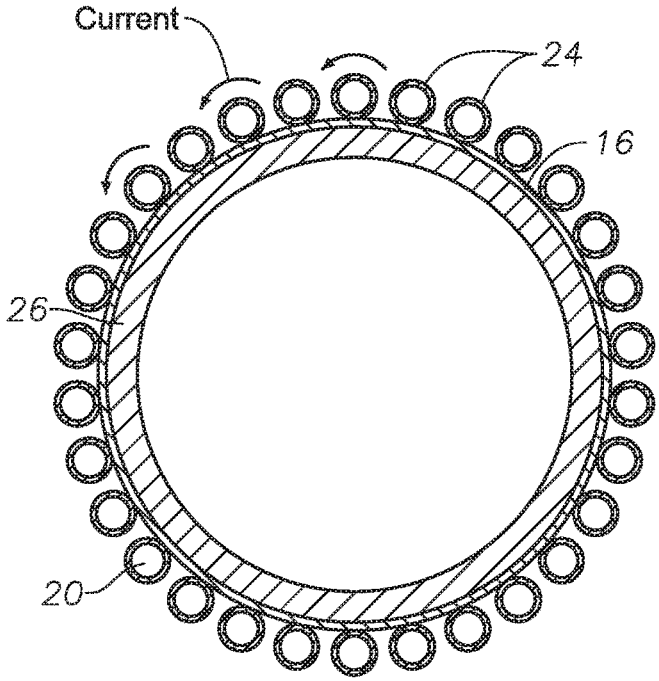
FIG. 1F is a cross-sectional depiction of the tubular of FIG. 1E along line 1F-1F.
Figure 1E:
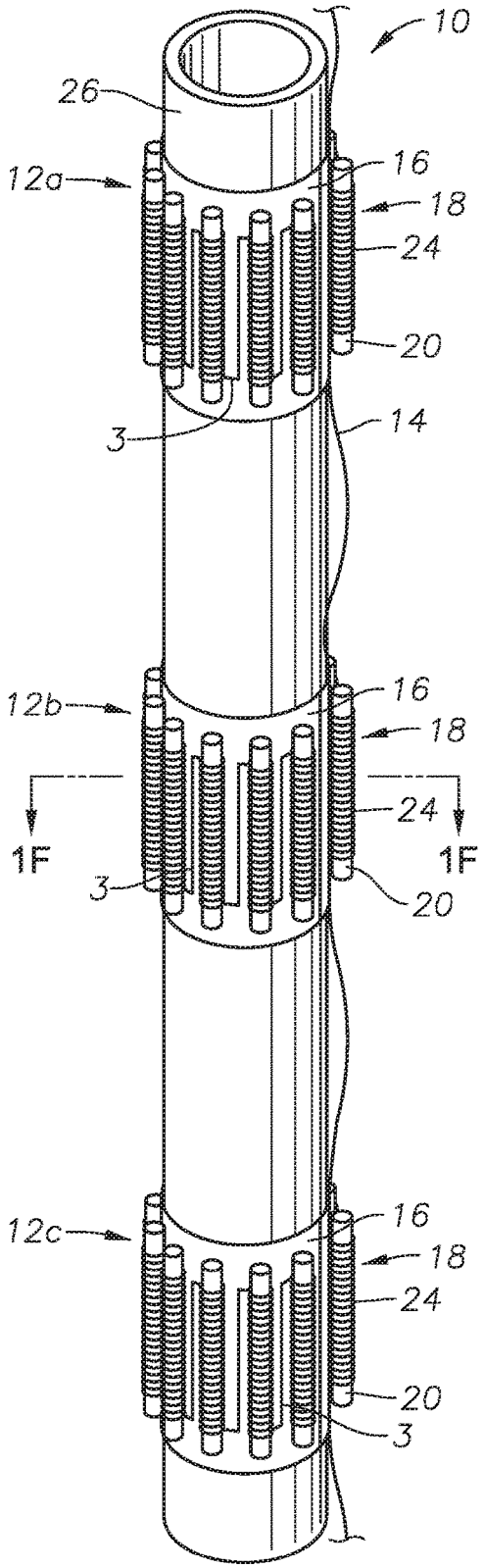
FIG. 1E shows a plurality of sensor assemblies attached to a tubular, according to any of the attachment methods described herein.

As described above, regardless of the securement method used, the present illustrative methods provide a fast and efficient way of deploying downhole sensors along a tubular string. The tubular string may take a variety of forms, including for example, a casing string, production string or drilling string. FIG. 1E shows a plurality of sensor assemblies 18 attached to a tubular, according to any of the attachment methods described herein. Here, tubular 26 may be a variety of downhole tubulars as previously stated. FIG. 1F is a cross-sectional depiction of the tubular of FIG. 1E along line 1F-1F. As can be seen, flexible backing 16 has a plurality of small sensors (e.g., coils 24 on ferrite core 20) connected in series (the arrows indicate the direction of the current flowing through the coils which, in this embodiment, is being supplied via cable 14. For simplicity, a flexible backing connector or securement mechanism is not shown. Moreover, as can be seen in FIGS. 1A, 1C and 1E, each sensor 18 is coupled to one another in-series via a wire 3 to receive the power and/or data signals communicated via cable 14.

Although not shown in FIGS. 1A-1F, sensor array 10 may be communicably coupled to a system control center ("SCC") (not shown), along with necessary processing/storage/communication circuitry, via cable 14. The SCC may be located downhole or at a remote location. As such, during downhole operations, the SCC may control and communicate with sensor array 10 to acquire and process any variety of parameters sensed using the sensor array. During operation, sensors 18 of a given sensor assembly may be activated in series by the SCC in order to transmit and/or receive sensed parameters. With reference to FIG. 1F, SCC may activate coils 24 in series so that they act as an omni-directional equivalent coil or toroid. When coils 24 are oriented such that their axes are parallel to the axis of tubular 26 (such as shown in FIGS. 1A-1F), coils 24 act as an equivalent axial coil.

Figure 1H:
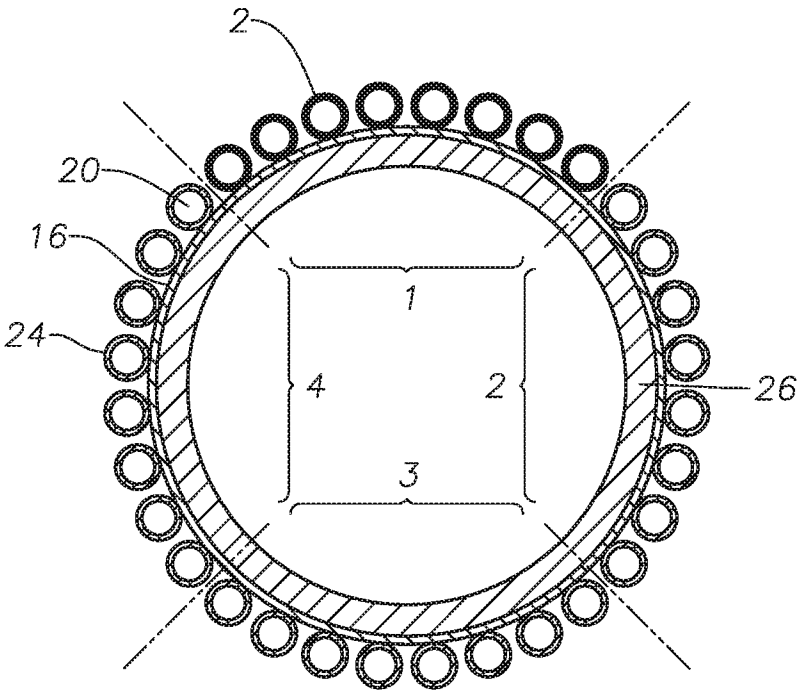
FIG. 1H is a cross-sectional depiction of the tubular of FIG. 1E along line 1F-1F, showing an azimuthally sensitive embodiment of the present disclosure.
Figure 1G:
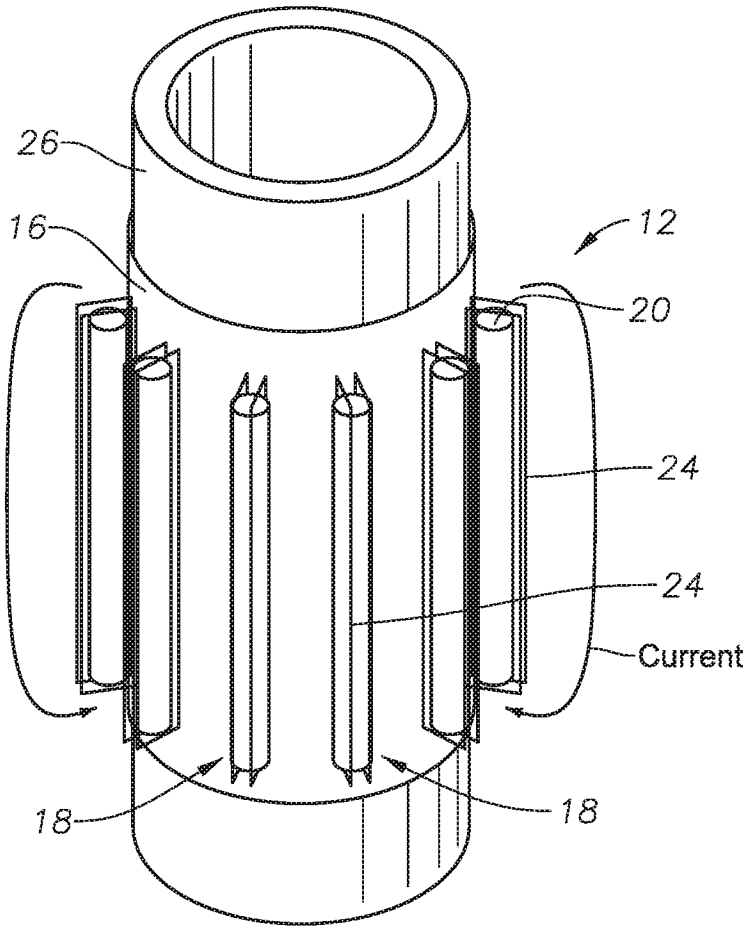
FIG. 1G depicts a sensor assembly having coils acting as an equivalent toroid.

Alternatively, when coils 24 are oriented such that their axes are transverse to the tubular axis, the coils 24 act as an equivalent toroid. FIG. 1G depicts a sensor assembly having coils acting as an equivalent toroid. Sensor assembly 12 of FIG. 1G is similar to those of other embodiments described herein, as like elements refer to like components. However, in this illustrative embodiment, coils 24 are wrapped around ferrite cores 20 of each sensor 18 such that the axes of coils 24 is transverse to the axis of tubular 26. Thus, sensors 18 act as an equivalent toroid. As can be seen, ferrite cores 20 of each sensor 18 of sensor assembly 12

In yet other embodiments, sensors 18 may be azimuthally separated into directionally sensitive groups. FIG. 1H is a cross-sectional depiction of the tubular of FIG. 1E along line 1F-1F. In this embodiment, however, sensors 18 (comprised of coils 24 and ferrite core 20) are communicably coupled to one another in groups which are excited independently. As illustrated in this example, there are 4 groups of sensors 18. Here, group 1 is being excited (thus, group 1 is illustrated in bold). Nevertheless, the SCC may individually activate each group as desired in order to provide directional sensitivity during sensing operations.

Figure 2A:
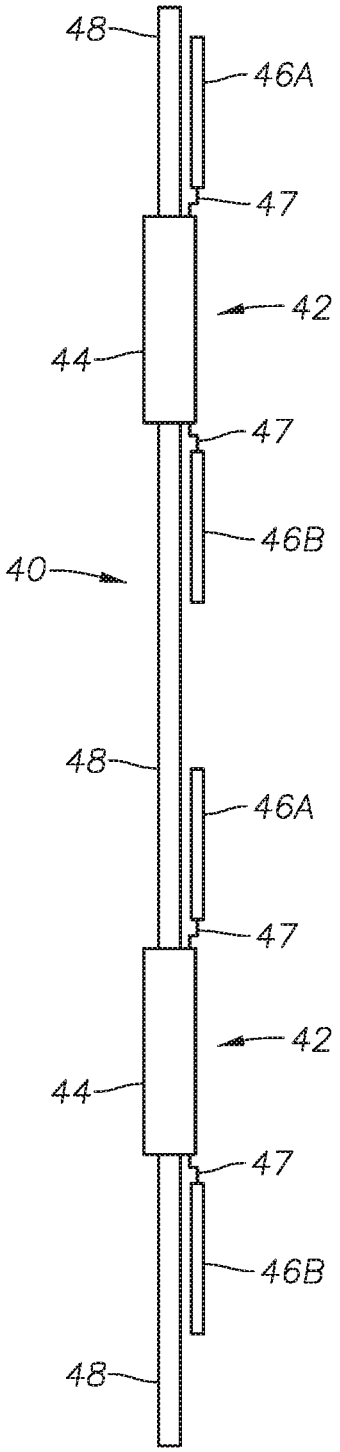
FIGS. 2A, 2B and 2C illustrate reelable fiber optic sensor arrays, according to certain illustrative embodiments of the present disclosure.
Figure 2B:
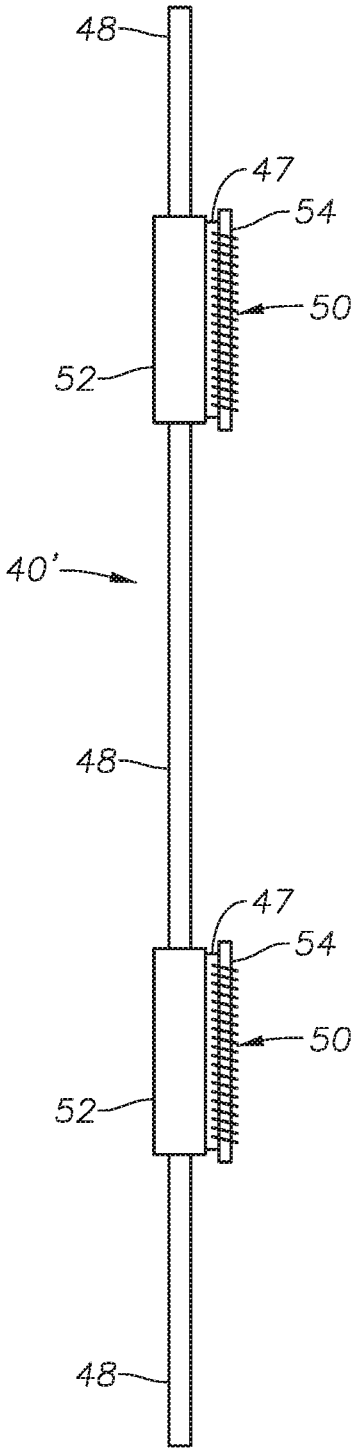
Figure 2C:
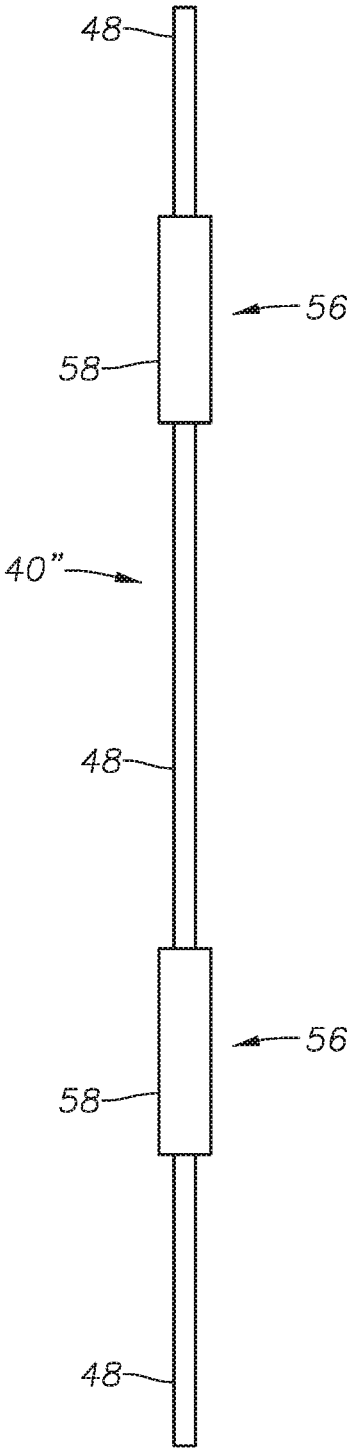

FIGS. 2A, 2B and 2C illustrate reelable fiber optic sensor arrays, according to certain illustrative embodiments of the present disclosure. In FIGS. 2A-2C, fiber optic sensor arrays 40, 40', and 40", respectively, include fiber optic sensors housed in a sensor package and connected through a fiber optic cable in a serial manner. In FIG. 2A, for electric field sensing, fiber optic sensors 42 include a transducer (not shown) located in a sensor housing 44, which is connected to E-field sensing electrodes 46A and 46B via connectors 47. Electric field sensing sensors 42 are communicably coupled to one another via fiber optic cable 48 to transmit light signals, as understood in the art.

FIG. 2B illustrates a fiber optic induction sensor array 40' having a plurality of induction sensors 50 thereon. Induction sensor(s) 50 consists of a fiber optic transducer (not shown) in a housing 52 connected to a sensing coil 54, such that the magnetic field induced voltage across the sensing coil is applied to the fiber optic transducer, and this in turn modulates the optical signal. FIG. 2C illustrates a fiber optic magnetic field sensor array 40" consisting of magnetic field sensors 56, each having a magnetostrictive material (not shown) positioned inside housing 58 and bonded to fiber optic cable 48.

Figure 2D:
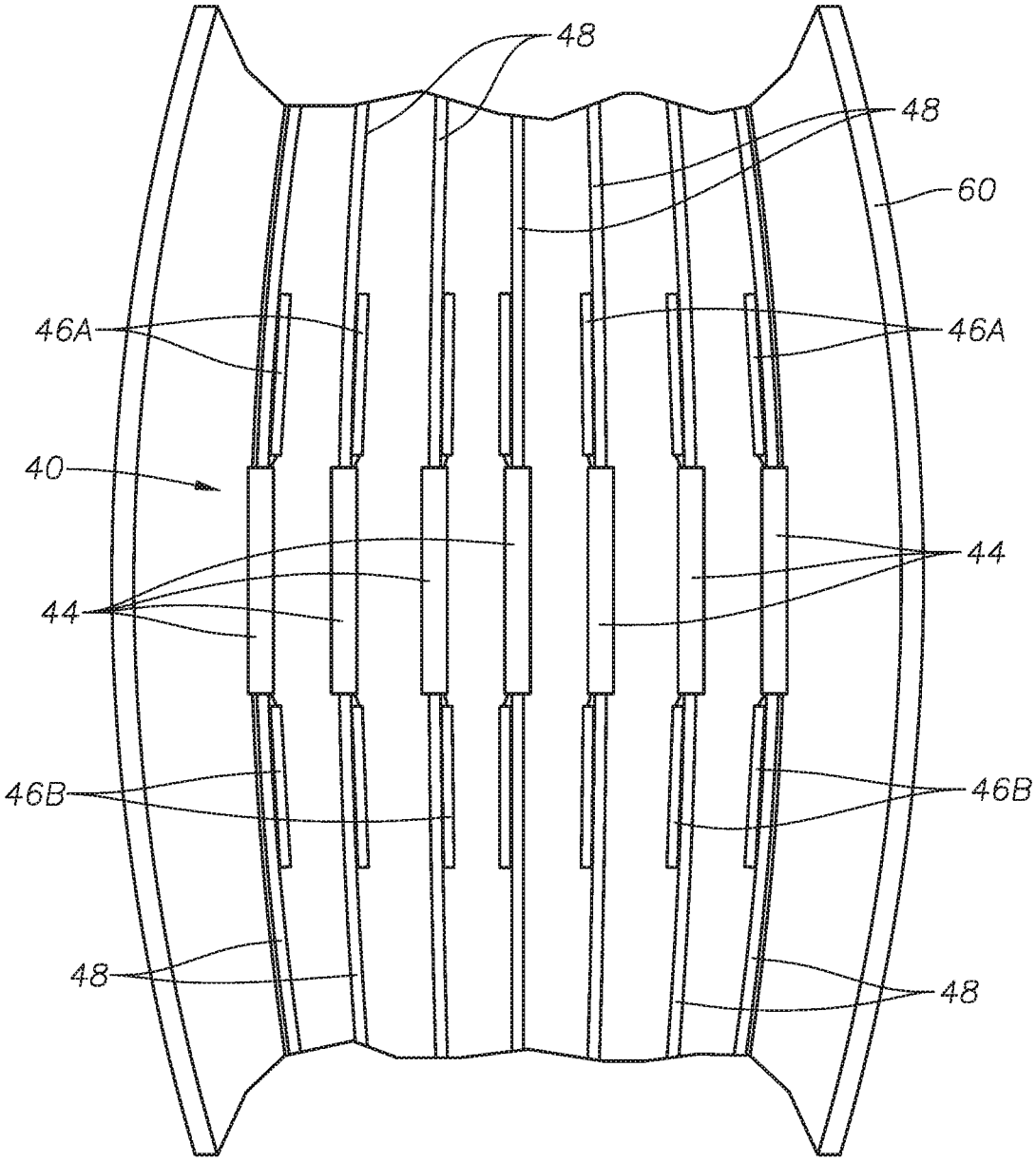
FIGS. 2D and 2E show alternative embodiments of fiber optic sensors arrays reeled onto spools.
Figure 2E:
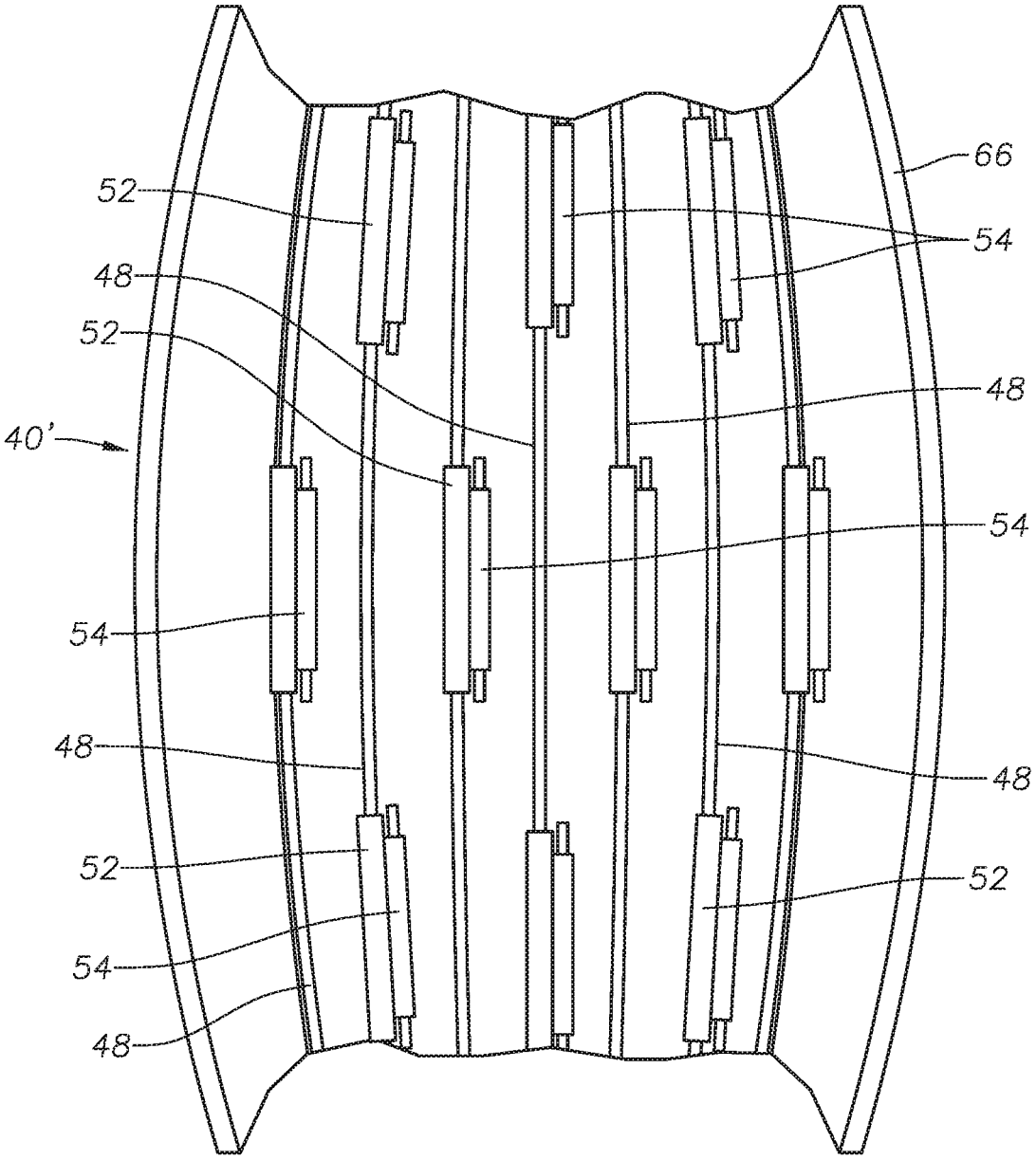
Figure 2F:
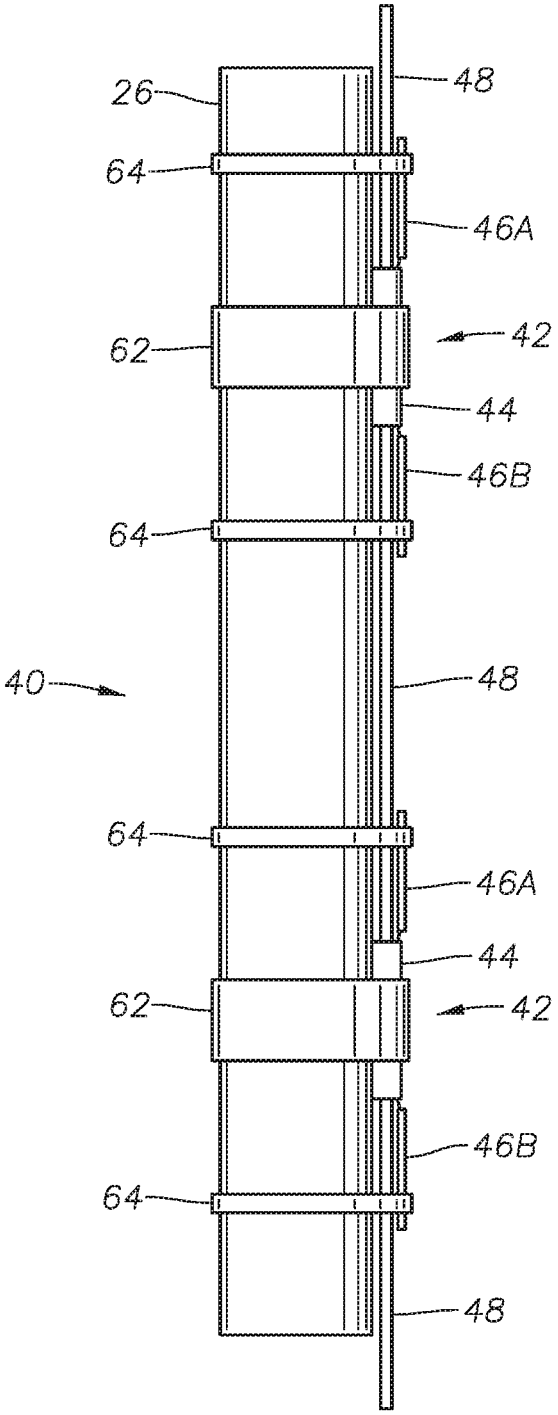
FIGS. 2F and 2G show the fiber optic sensor arrays of FIGS. 2D and 2E, respectively, being attached to a tubular as it is deployed downhole.

As with other embodiments described herein, the fiber optic sensor arrays 40, 40' and 40" are pre-manufactured as shown in FIGS. 2A-2C and, thereafter, reeled onto a spool. FIGS. 2D and 2E show fiber optic sensors arrays 40 and 40', respectively, reeled onto spools. In FIG. 2D, sensor array 40 has been reeled onto spool 60. When it is time to deploy fiber optic sensor array 40, it is unreeled from spool 60 and attached to tubular 26 as shown in FIG. 2F. In order to secure sensor array 40 to tubular 26, clamps 62 are positioned around sensor housing 44. At same time, clamps 64 are placed around sensing electrodes 46A and 46B; however, clamps 64 are non-conductive in order to allow detection of EM fields. The clamps may take a variety of forms including the clamps described herein or, for example, a two-part clamp having mating "J" shaped ends.

Figure 2G:
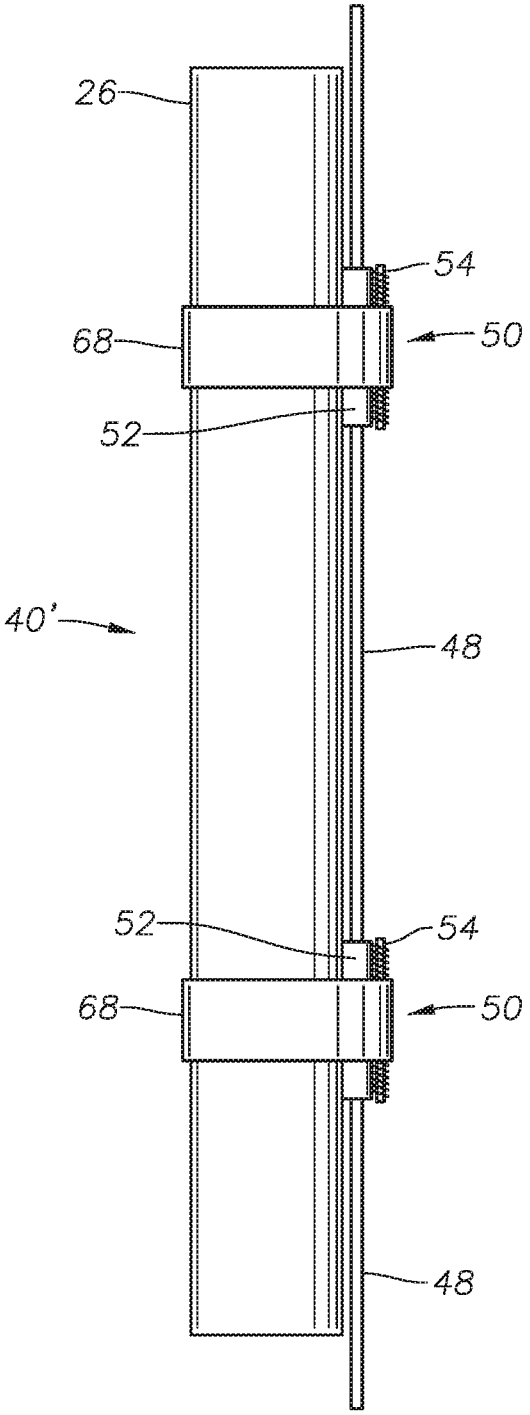

FIGS. 2E and 2G illustrate fiber optic sensor array 40' on a spool (FIG. 2E) and being attached to a tubular 26 (FIG. 2G) as it is being deployed downhole. Here, after sensor array 40' is fabricated, it is reeled onto spool 66. When ready to deploy sensor array 40', it is reeled from spool 66 and attached to tubular 26, as shown in FIG. 2G. In order to secure induction sensors 50, non-conductive clamps 68 are positioned around sensors 50 as tubular 26 is lowered into the well. Also, note that although only a single fiber optic sensor is shown as the fiber optic sensor assemblies, more than one fiber optic sensor may be utilized.

Figure 3A:
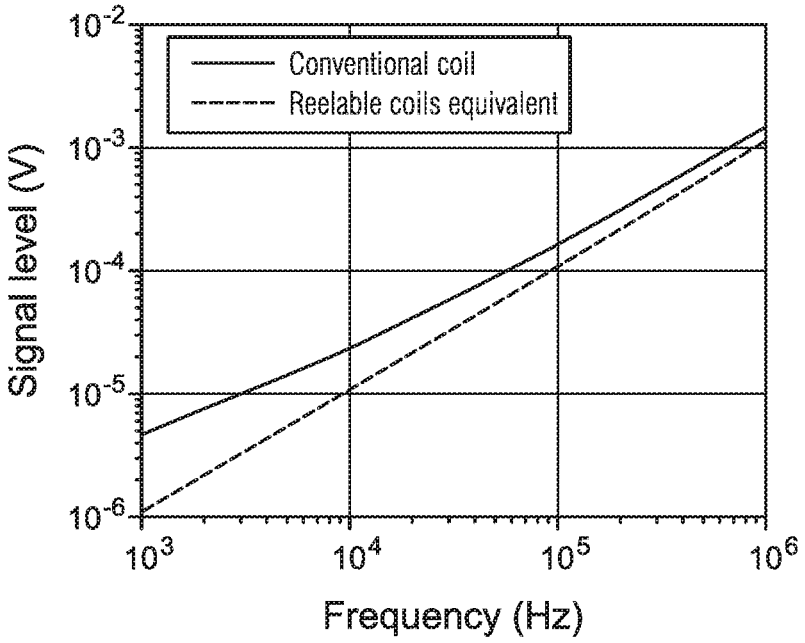
FIG. 3A is a graph plotting the signal levels of conventional coils vs. the illustrative sensors described herein.
Figure 3B:
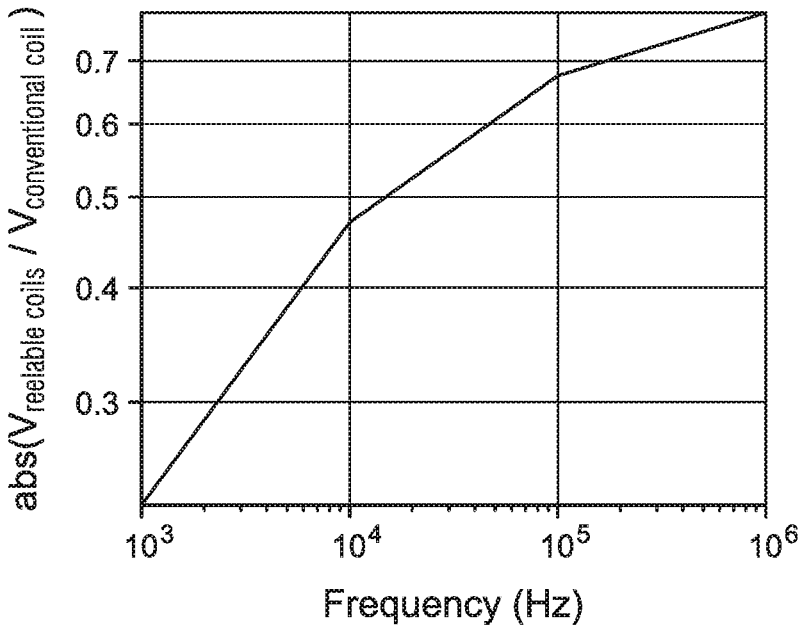
FIG. 3B shows the ratio of the signals of FIG. 3A.

The signal levels of the illustrative embodiments described herein and conventional sensors were simulated and compared. FIG. 3A is a graph plotting the signal levels of conventional coils vs. the illustrative sensors described herein. FIG. 3B shows the ratio of the signals. In the simulation, the following model parameters were chosen: a casing diameter of 7" OD, 0.2" thick, made of carbon steel (conductivity=$10^7$ S/m, relative permeability=100); conventional coil diameter of 8"; a reelable sensor design of the present disclosure included 48 coils equally spaced, being 0.5" in diameter, and all were excited in series; transmitter current=1 A; transmitter length=6"; receiver having a magnetic dipole with unit moment, 5 ft away along casing axis; and a formation resistivity of 100 Ohm-m. FIGS. 3A and 3B show the results of the simulation, where the signal level of the reelable coils is on the same magnitude as the conventional transmitters which must be constructed on collars at the well site. Thus, the graphs show the reelable sensors of the present disclosure will perform as good as, if not superior to, conventional sensors, without the extra time required to construct the sensors at the well site.

Figure 4:
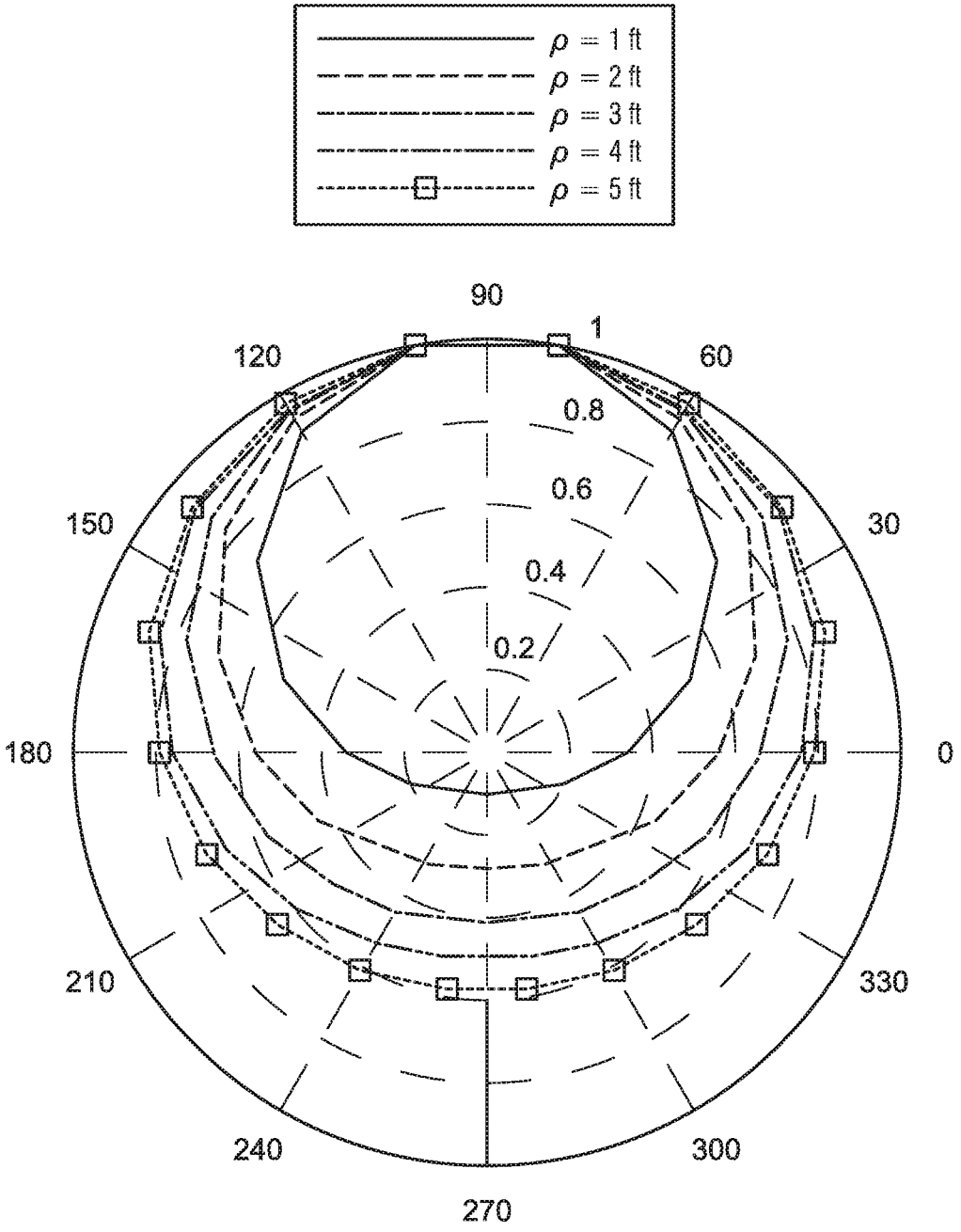
FIG. 4 shows a normalized plot of the signals received at different depths in the formation using an azimuthally sensitive sensor array as described herein.

A model for azimuthally sensitive sensor array was also built and simulated. The azimuthally sensitive sensor(s) were constructed using coils and grouped together as described herein and illustrated in FIG. 1H, and excited independently. FIG. 4 shows a normalized plot of the signals received at different depths in the formation. In the simulation, the following model parameters were chosen: a casing diameter of 7" OD, 0.2" thick, and made of carbon steel (conductivity=$10^7$ S/m, relative permeability=100); and a reelable sensor design of the present disclosure having 48 coils equally spaced, each being 0.5" diameter. During the simulation, 13 coils (a group) were excited in series, along with a transmission current=1 A, a receiver with a magnetic dipole with unit moment at the shown radial depths p inside the formation, with a formation resistivity of 100 Ohm-m. As can be seen, when group 1 (FIG. 1H) is excited, the signal is maximized at the corresponding 90 degree angle, while the signal reduces at other angles. As the radial distance from the tubular p increases, the directionality of the signal decreases. Nevertheless, embodiments of the present disclosure are clearly sensitive to signals at different depths into the formation.

The illustrative sensors described herein may take a variety of forms, such as, for example, magnetic or electric sensors, and may communicate in real-time. Illustrative magnetic sensors may include coil windings and solenoid windings that utilize induction phenomenon to sense conductivity of the earth formations. Illustrative electric sensors may include electrodes, linear wire antennas or toroidal antennas that utilize Ohm's law to perform the measurement. In addition, the sensors may be realizations of dipoles with an azimuthal moment direction and directionality, such as tilted coil antennas. In addition, the sensors may be adapted to perform sensing (e.g., logging) operations in the up-hole or downhole directions.

The various embodiments and method described herein may be utilized used for any application that requires temporary or permanent coil/toroid and receiver deployment inside or outside the casing. Such applications include, for example, production fluid analysis, waterflood monitoring in enhanced oil recovery environments, monitoring borehole cement, monitoring casing integrity, monitoring the operational condition of sliding sleeves, telemetry, etc. Since the sensor arrays are pre-manufactured, they may be readily reeled onto a spool and deployed in a fast and efficient manner at the well site, thus significantly reducing rig time and the associated costs.

Embodiments and methods of the present disclosure described herein further relate to any one or more of the following paragraphs:

1. A reelable sensor array, comprising a plurality of sensors coupled one to another via a cable to form a reelable sensor array, wherein the reelable sensor array is adapted to be reeled onto a spool, unreeled from the spool, and attached to a tubular.

2. A reelable sensor array as defined in paragraph 1, further comprising a plurality of flexible backings, wherein each flexible backing has a plurality of sensors thereon.

3. A reelable sensor array as defined in paragraphs 1 or 2, wherein the sensors are oriented on the flexible backings such that their axes are parallel to an axis of the tubular.

4. A reelable sensor array as defined in any of paragraphs 1-3, wherein the sensors are oriented on the flexible backings such that their axes are transverse to an axis of the tubular.

5. A reelable sensor array as defined in any of paragraphs 1-4, wherein the sensors on the flexible backings are coupled to one another in series.

6. A reelable sensor array as defined in any of paragraphs 1-5, wherein the sensors on the flexible backings are azimuthally separated into directionally sensitive groups.

7. A reelable sensor array as defined in any of paragraphs 1-6, wherein the sensors are transmitters or receivers.

8. A reelable sensor array as defined in any of paragraphs 1-7, wherein the sensors are coils, toroids, galvanic electrodes, capacitive electrodes, or fiber optic sensors.

9. A reelable sensor array as defined in any of paragraphs 1-8, wherein the cable is at least one of a power, data communication, or fiber optic cable.

10. A reelable sensor array as defined in any of paragraphs 1-9, wherein the flexible backing comprises an adhesive on a side opposite a side on which the sensors are positioned.

11. A reelable sensor array as defined in any of paragraphs 1-10, wherein the flexible backing comprises a connector to connect opposite ends of the flexible backing.

12. A reelable sensor array as defined in any of paragraphs 1-11, wherein the flexible backing further comprises pockets into which the sensors are positioned.

13. A method for deploying reelable sensors into a downhole wellbore, the method comprising unreeling a sensor array from a spool, the sensor array comprising a plurality of sensors communicably coupled one to another via a cable; attaching the sensor array to a tubular; and deploying the tubular downhole into a wellbore.

14. A method as defined in paragraph 13, wherein the plurality of sensors are used as transmitters or receivers.

15. A method as defined in paragraphs 13 or 14, wherein the sensor array is attached to the tubular as the tubular is being deployed into the wellbore.

16. A method as defined in any of paragraphs 13-15, wherein attaching the sensor array to the tubular comprises clamping the sensor array to the tubular.

17. A method as defined in any of paragraphs 13-16, wherein the sensor array comprises a plurality of flexible backings, each flexible backing having a plurality of sensors attached thereto; and attaching the sensor array to the tubular comprises wrapping the flexible backings around the tubular.

18. A method as defined in any of paragraphs 13-17, wherein attaching the sensor array further comprises securing the flexible backing around the tubular using connectors forming part of the flexible backing.

19. A method as defined in any of paragraphs 13-18, wherein attaching the sensor array further comprises securing the flexible backing around the tubular using adhesive.

20. A method as defined in any of paragraphs 13-19, wherein attaching the sensor array further comprises clamping the cable to the tubular.

21. A method as defined in any of paragraphs 13-20, further comprising exciting each sensor on a flexible backing in-series.

22. A method as defined in any of paragraphs 13-21, further comprising exciting each sensor on a flexible backing azimuthally.

23. A method as defined in any of paragraphs 13-22, wherein the tubular is deployed as a drilling, casing, or production string.

24. A method of assembling a downhole reelable sensor array, the method comprising fabricating a plurality of sensors; communicably coupling the sensors using a cable, thereby forming a reelable sensor array; and reeling the sensor array onto a spool.

25. A method as defined in paragraph 24, further comprising positioning the spool near a wellbore; unreeling the sensor array from the spool; attaching the sensor array to a tubular; and deploying the tubular downhole into the wellbore.

26. A method as defined in paragraphs 24 or 25, wherein the sensors are fabricated as a plurality of flexible backings having sensors thereon.

27. A method as defined in any of paragraphs 24-26, wherein reeling the sensor array onto the spool comprises wrapping the flexible backings around a rigid body; and reeling the sensor array onto a spool.

28. A method as defined in any of paragraphs 24-27, wherein attaching the sensor array to the tubular comprises wrapping the flexible backings around the tubular.

29. A method as defined in any of paragraphs 24-28, wherein attaching the sensor array to the tubular comprises clamping the sensor array to the tubular.

30. A method as defined in any of paragraphs 24-29, wherein attaching the sensor array to the tubular comprises clamping securing the flexible backing array to the tubular using adhesive.

31. A method as defined in any of paragraphs 24-30, wherein the tubular is deployed downhole as a drilling, casing or production string.

Although various embodiments and methods have been shown and described, the disclosure is not limited to such embodiments and methodologies and will be understood to include all modifications and variations as would be apparent to one skilled in the art. Therefore, it should be understood that the disclosure is not intended to be limited to the particular forms disclosed. Rather, the intention is to cover all modifications, equivalents and alternatives falling within the spirit and scope of the disclosure as defined by the appended claims.

What is claimed is:

1. A reelable sensor array, comprising: a plurality of sensors coupled one to another via a cable to form a reelable sensor array, wherein the reelable sensor array is adapted to be reeled onto a spool, unreeled from the spool, and attached to a tubular, wherein the reelable sensor array consists of a plurality of flexible elastomer backings in which a length of each of the flexible elastomer backings is shorter than a circumference of the tubular, wherein of each of the flexible elastomer backings comprises a connector to connect opposite ends of the flexible backing, and wherein of each of the flexible elastomer backings are stretched and wrapped around the tubular, and the opposite ends connected via the connector to compress each of the flexible elastomer backings against the tubular.

2. A reelable sensor array as defined in claim 1, wherein each flexible elastomer backing has a plurality of sensors thereon.

3. A reelable sensor array as defined in claim 2, wherein the sensors are oriented on the flexible elastomer backings such that their axes are parallel to an axis of the tubular.

4. A reelable sensor array as defined in claim 2, wherein the sensors are oriented on the flexible elastomer backings such that their axes are transverse to an axis of the tubular.

5. A reelable sensor array as defined in claim 2, wherein the sensors on the flexible elastomer backings are coupled to one another in series.

6. A reelable sensor array as defined in claim 2, wherein the sensors on the flexible elastomer backings are azimuthally separated into directionally sensitive groups.

7. A reelable sensor array as defined in claim 2, wherein the sensors are transmitters or receivers.

8. A reelable sensor array as defined in claim 2, wherein the sensors are coils, toroids, galvanic electrodes, capacitive electrodes, or fiber optic sensors.

9. A reelable sensor array as defined in claim 2, wherein the cable is at least one of a power, data communication, or fiber optic cable.

10. A reelable sensor array as defined in claim 2, wherein the flexible elastomer backing comprises an adhesive on a side opposite a side on which the sensors are positioned.

11. A reelable sensor array as defined in claim 2, wherein the flexible elastomer backing further comprises pockets into which the sensors are positioned.

12. A reelable sensor array as defined in claim 1, wherein the sensors comprise:

a sensor housing;

a first electrode axially separated from the sensor housing in a first direction; and a second electrode axially separated from the sensor housing in a second direction opposite the first direction.

13. A method for deploying reelable sensors into a downhole wellbore, the method comprising:

unreeling a sensor array from a spool, the sensor array comprising a plurality of sensors communicably coupled one to another via a cable, wherein the sensor array consists of a plurality of flexible elastomer backings, each flexible elastomer backing comprising a connector to connect opposite ends of the flexible backing;

attaching the sensor array to a tubular by stretching and wrapping the flexible elastomer backing around a tubular, and connecting the opposite ends via the connector to compress the flexible elastomer backing against the tubular, wherein the flexible elastomer backings have lengths which are shorter than a circumference of the tubular; and deploying the tubular downhole into a wellbore.

14. A method as defined in claim 13, wherein the plurality of sensors are used as transmitters or receivers.

15. A method as defined in claim 13, wherein the sensor array is attached to the tubular as the tubular is being deployed into the wellbore.

16. A method as defined in claim 13, wherein attaching the sensor array to the tubular comprises clamping the sensor array to the tubular.

17. A method as defined in claim 13, wherein:

each flexible elastomer backing has a plurality of sensors attached thereto.

18. A method as defined in claim 17, wherein attaching the sensor array further comprises securing the flexible elastomer backing around the tubular using adhesive.

19. A method as defined in claim 13, wherein attaching the sensor array further comprises clamping the cable to the tubular.

20. A method as defined in claim 13, further comprising exciting each sensor on a flexible elastomer backing in-series.

21. A method as defined in claim 13, further comprising exciting each sensor on a flexible elastomer backing azimuthally.

22. A method as defined in claim 13, wherein the tubular is deployed as a drilling, casing, or production string.

* * * * *